US011763620B2

(12) United States Patent
Zheng et al.

(10) Patent No.: US 11,763,620 B2
(45) Date of Patent: Sep. 19, 2023

(54) CASH BOX AND CASH CIRCULATION PROCESSING DEVICE

(71) Applicant: SHANDONG NEW BEIYANG INFORMATION TECHNOLOGY CO., LTD., Shandong (CN)

(72) Inventors: Lei Zheng, Shandong (CN); Zhenxing Zhao, Shandong (CN); Maolin Liu, Shandong (CN); Chuntao Wang, Shandong (CN)

(73) Assignee: SHANDONG NEW BEIYANG INFORMATION TECHNOLOGY CO., LTD., Shandong (CN)

( * ) Notice: Subject to any disclaimer, the term of this patent is extended or adjusted under 35 U.S.C. 154(b) by 396 days.

(21) Appl. No.: 17/288,118

(22) PCT Filed: Sep. 27, 2019

(86) PCT No.: PCT/CN2019/108698
§ 371 (c)(1),
(2) Date: Apr. 23, 2021

(87) PCT Pub. No.: WO2020/082989
PCT Pub. Date: Apr. 30, 2020

(65) Prior Publication Data

US 2021/0383633 A1 Dec. 9, 2021

(30) Foreign Application Priority Data

Oct. 26, 2018 (CN) ..... 201811265526.7

(51) Int. Cl.
*G07D 11/12* (2019.01)

(52) U.S. Cl.
CPC ..... *G07D 11/12* (2019.01)

(58) Field of Classification Search
CPC ..... G07D 11/12
(Continued)

(56) References Cited

U.S. PATENT DOCUMENTS

2015/0277335 A1 10/2015 Bradford et al.
2017/0334675 A1 11/2017 Kim et al.

FOREIGN PATENT DOCUMENTS

CN 101206778 A 6/2008
CN 103136850 A 6/2013
(Continued)

OTHER PUBLICATIONS

International Search Report issued by the China National Intellectual Property Administration (ISA/CN) in connection to International Application No. PCT/CN2019/108698, dated Jan. 2, 2020, pp. 1-2, English translation.

(Continued)

*Primary Examiner* — Allyson N Trail
(74) *Attorney, Agent, or Firm* — George Likourezos; Carter, DeLuca & Farrell LLP

(57) ABSTRACT

Disclosed are a cash box and a cash recycling and handling device; the cash box includes a box body, a first cash storage cavity, a second cash storage cavity, a transfer passage, a first switching member and a linkage assembly; a first lifting platform is provided inside the first cash storage cavity, and the first lifting platform is capable of moving back and forth in the preset direction and can be located at a first dispensing position; when the first lifting platform is in the first dispensing position, it is engaged with the linkage assembly to rotate the first switching member to a first position, and when the first lifting platform moves to a first inlet, the linkage assembly rotates the first switching member to a second position.

20 Claims, 11 Drawing Sheets

(58) Field of Classification Search
USPC ..... 235/379
See application file for complete search history.

(56) References Cited

FOREIGN PATENT DOCUMENTS

| | | | |
|---|---|---|---|
| CN | 103456079 | A | 12/2013 |
| CN | 104134280 | A | 11/2014 |
| CN | 108416897 | A | 8/2018 |
| CN | 108573566 | A | 9/2018 |
| CN | 209044737 | U | 6/2019 |
| EP | 2669226 | A2 | 12/2013 |
| EP | 3279121 | A1 | 2/2018 |
| JP | 2016004518 | A | 1/2016 |

OTHER PUBLICATIONS

First Search of Chinese Prior Application No. 201811265526.7 pp. 1.
First Office Action of Chinese Prior Application No. 201811265526.7 dated Oct. 26, 2020, pp. 1-3.

CASH BOX AND CASH CIRCULATION PROCESSING DEVICE

The present disclosure is a U.S. National Stage Application of PCT Application Serial No. PCT/CN2019/108698, filed Sep. 27, 2019, which claims priority to Chinese Patent Application No. 201811265526.7 filed Oct. 26, 2018 with the CNIPA, the disclosures of which are incorporated herein by reference in their entireties.

TECHNICAL FIELD

The present disclosure relates to the technical field of cash processing devices such as cash boxes and cash recycling and handling devices.

BACKGROUND

A cash recycling and handling device based on relevant technologies includes a cash inlet and outlet, an identifying mechanism, a temporary storage mechanism, a cash box and transfer passages connecting with above mechanisms, etc. The cash box is used to store and distribute cash. Different types of cash need to be stored separately based on business needs. For example, for easy counting, Banknotes with denominations of RMB 50 yuan and RMB 100 yuan need to be stored separately; and for easy bank management, cash forgotten, negotiable cash and non-negotiable cash need to be stored separately.

An integrated two-cavity cash box based on relevant art is provided. The cash box adopts two cash collecting and separating mechanisms for conveying cash to or out of two cash storage cavities respectively. The two cash storage cavities are both provided with a lifting platform for supporting cash, and the inlet or outlet of the two cash storage cavities is further provided with a switching member for connecting the inlet or outlet of the cash storage cavities with an inlet and outlet of the cash box. In order to convey the cash to or out of two cash storage cavities, the lifting platform and switching member of two cash storage cavities need to be driven by power. Therefore, the cash box has problems such as high cost and complicated control.

SUMMARY

The present disclosure provides a cash box with low cost and simple control.

The present disclosure further provides a cash recycling and handling device using the cash box with low cost and simple control.

Embodiments of the present disclosure are achieved in the manners described below:

The present disclosure provides a cash box including a box body which has a first inlet and outlet; a first cash storage cavity and a second cash storage cavity provided in the box body in sequence in a preset direction, a first inlet and a first outlet are respectively arranged at the two ends of the first cash storage cavity in the preset direction, and a first lifting platform is provided inside the first cash storage cavity, and the first lifting platform is capable of moving back and forth in the preset direction and is capable of being located at a first dispensing position adjacent to the first outlet, and one end of the second cash storage cavity adjacent to the first outlet is provided with a second inlet and outlet; a transfer passage connecting the first inlet and outlet and the second inlet and outlet; a first switching member rotatably provided in the transfer passage, the first switching member is capable of being located at a first position and a second position, and when the first switching member is located at the first position, the first inlet and outlet is connected with the first outlet and is disconnected from the second inlet and outlet, and when the first switching member is located at the second position, the first inlet and outlet is disconnected from the first outlet and is connected with the second inlet and outlet; a linkage assembly in transmission connection with the first switching member, the linkage assembly is capable of engaging with or separated from the first lifting platform, and when the first lifting platform moves to the first dispensing position, the first lifting platform is engaged with the linkage assembly to rotate the first switching member to the first position, and when the first lifting platform moves to the first inlet, the linkage assembly rotates the first switching member to the second position.

The present disclosure further provides a cash recycling and handling device including a common passage configured to convey cash, and the cash box mentioned above.

BRIEF DESCRIPTION OF DRAWINGS

The drawings used in the description of the embodiments will be briefly described below. It is to be understood that the subsequent drawings only illustrate part of embodiments of the present disclosure, and therefore should not be construed as limiting the scope. Those of ordinary skill in the art may obtain other drawings based on the drawings described below on the premise that no creative work is done.

Figure 1:
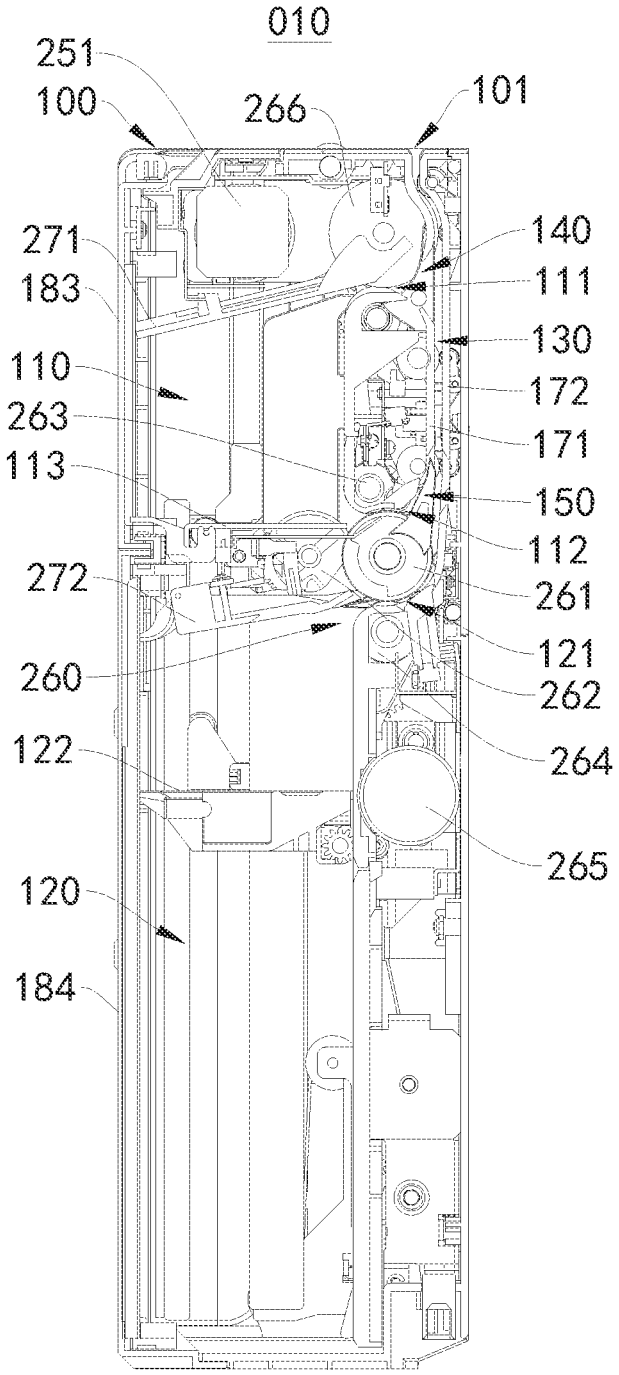
FIG. 1 is a section view of a cash box in a first state according to an embodiment of the present disclosure.

In the figure: 010—cash box; 020—cash recycling and handling device; 100—box body; 101—first inlet and outlet; 110—first cash storage cavity; 111—first inlet; 112—first outlet; 113—first lifting platform; 114—pressing part; 120—second cash storage cavity; 121—second inlet and outlet; 122—second lifting platform; 130—transfer passage; 140—second switching member; 150—first switching member; 151—switching shaft; 160—resisting part; 171—first passage plate; 172—second passage plate; 173—third passage plate; 181—first opening; 182—second opening; 183—first box door; 184—second box door; 185—pivot shaft; 200—linkage assembly; 210—driving member; 211—driving slot; 212—limiting part; 220—connecting member; 221—stressed part; 222—driving part; 223—detection part; 224—connecting shaft; 230—elastic element; 240—sensor; 250—driving assembly; 251—first motor; 252—driving wheel; 253—driving belt; 254—belt pulley; 260—cash collecting and separating mechanism; 261—separation roller; 262—pickup roller; 263—first gate roller; 264—second gate roller; 265—second motor; 271—first guiding plate; 272—second guiding plate; 266—feeding roller; 310—feeding mechanism; 320—dispensing mechanism; 330—temporary storage mechanism; 340—cash identifying mechanism; 350—common passage.

DETAILED DESCRIPTION

The solutions in embodiments of the present disclosure will be clearly and completely described in conjunction with the drawings in the embodiments of the present disclosure. Apparently, the embodiments described below are part, not all, of the embodiments of the present disclosure. Generally, the components in the embodiments of the present disclosure described and illustrated in the drawings herein may be arranged and designed through various configurations.

Therefore, the following detailed description of the embodiments of the present disclosure shown in the drawings is not intended to limit the scope of the present disclosure, but merely illustrates the selected embodiments of the present disclosure. Based on the embodiments described herein, all other embodiments obtained by those of ordinary skill in the art without creative work are within the scope of the present disclosure.

It is to be noted that similar reference numerals and letters indicate similar items in the subsequent drawings, and therefore, once a particular item is defined in one drawing, the item needs no more definition and explanation in subsequent drawings.

In the description of the embodiments of the present disclosure, it is to be noted that the orientational or positional relationships indicated by terms "above", "below", "left", "right", "vertical", "horizontal" and the like are based on the orientational or positional relationships illustrated in the drawings or the orientational or positional relationship that products of the present disclosure are usually used in, which are for the mere purpose of facilitating and simplifying the description of the present disclosure and do not indicate or imply that the device or element referred to has a specific orientation and is constructed and operated in a specific orientation, and thus it is not to be construed as limiting the present disclosure. Moreover, terms "first", "second" and "third" are merely for distinguishing the description and are not to be construed as indicating or implying relative importance. It needs to be noted in the description of the embodiment that unless otherwise specified or restricted, the words of "setting" and "connection" shall be understood as a general sense. For example, the connection can be fixed connection, removable connection, integrated connection, mechanical connection, electrical connection, direct connection, indirect connection through intermediate media or connection between two components. Persons of ordinary skill in the art of the present disclosure can understand the specific meanings of the terms above in the embodiment as the case may be.

Figure 2:
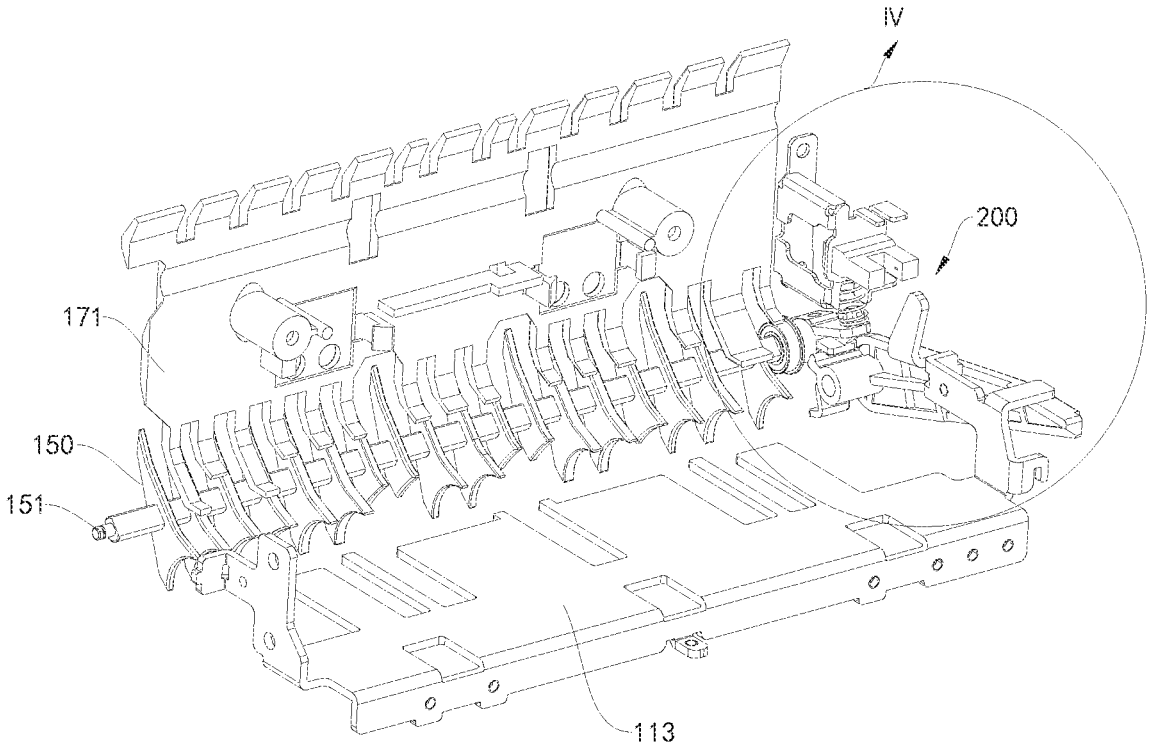
FIG. 2 is a structural schematic view of a first view of a linkage assembly and a first switching member when a first lifting platform is in a first dispensing position according to an embodiment of the present disclosure.
Figure 3:
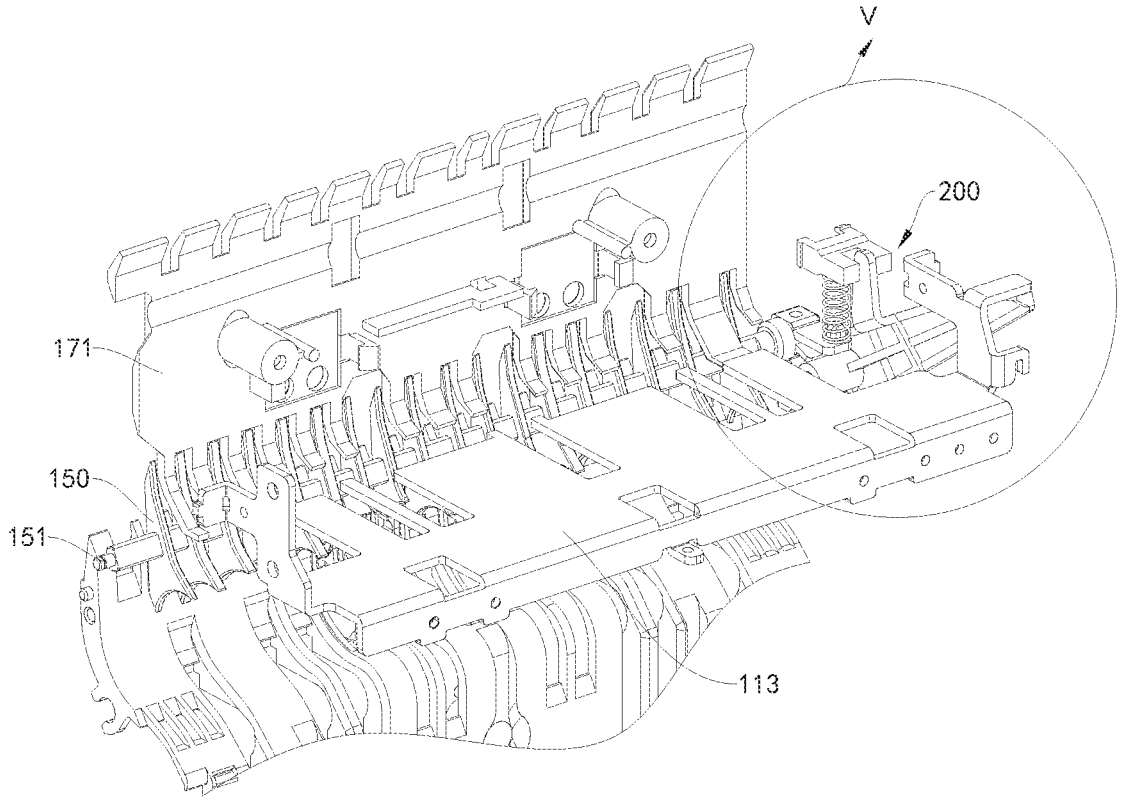
FIG. 3 is a structural schematic view of the first view of a linkage assembly and a first switching member when a first lifting platform is in an initial position according to an embodiment of the present disclosure.

FIG. 1 is a section view of a cash box 010 in a first state according to an embodiment of the present disclosure; FIG. 2 is a structural schematic view of a first view of a linkage assembly 200 and a first switching member 150 when a first lifting platform 113 is in a first dispensing position according to an embodiment of the present disclosure; FIG. 3 is a structural schematic view of the first view of a linkage assembly 200 and a first switching member 150 when a first lifting platform 113 is in an initial position according to an embodiment of the present disclosure. Referring to FIGS. 1-3, a cash box 010 is provided in the embodiment. The cash box 010 includes a box body 100, a transfer passage 130, a first switching member 150 and a linkage assembly 200, wherein the box body 100 is provided with a first inlet and outlet 101. A first cash storage cavity 110 and a second cash storage cavity 120 are provided in the box body 100 in a preset direction. The two ends of the first cash storage cavity 110 are provided with a first inlet 111 and a first outlet 112 respectively in the preset direction. A first lifting platform 113 is provided inside the first cash storage cavity 110, and the first lifting platform 113 is capable of moving back and forth in the preset direction and can be located at a first dispensing position adjacent to the first outlet 112. The end of the second cash storage cavity 120 adjacent to the first outlet 112 is provided with a second inlet and outlet 121. The transfer passage 130 connects the first inlet with outlet 101 and the second inlet and outlet 121. The first switching member 150 is rotatably provided in the transfer passage 130 and can be located at a first position or a second position. When the first switching member 150 is located at the first position, the first inlet and outlet 101 is connected with the first outlet 112 by at least a part of the transfer passage 130 and the first inlet and outlet 101 is disconnected from the second inlet and outlet 121 by the first switching member 150. When the first switching member 150 is located at the second position, the first inlet and outlet 101 is disconnected from the first outlet 112 by the first switching member 150 and the first inlet and outlet 101 is connected with the second inlet and outlet 121 by the transfer passage 130. The linkage assembly 200 is in transmission connection with the first switching member 150, and it is engaged with or separated from the first lifting platform 113. When the first lifting platform 113 moves to the first dispensing position, the first lifting platform 113 is engaged with the linkage assembly 200 to rotate the first switching member 150 to the first position. When the first lifting platform 113 leaves the first dispensing position and moves to the first inlet 111, the first lifting platform 113 is separated from the linkage assembly 200, and the linkage assembly 200 rotates the first switching member 150 to the second position. According to the embodiment of the present disclosure, the cash box 010 does not need to be provided with a separate driving mechanism to control the switch of the first switching member 150 between the first position and the second position, instead, the linkage assembly 200 is driven by the first lifting platform 113 moving to the first dispensing position to drive the linkage assembly 200 which accordingly rotates the first switching member 150 to the first position, or uses the linkage assembly 200 drive the rotation of the first switching member 150 to the second position when the first lifting platform 113 moves toward the first inlet 111, thus reducing the cost and simplifying the control of the cash box 010.

In this embodiment, the cash box 010 further includes a second switching member 140 rotatably arranged in the transfer passage 130, and the second switching member 140 is configured to control the connection or disconnection between the first inlet and outlet 101 and the first inlet 111. The preset direction is vertical in this embodiment, and the first cash storage cavity 110 is located above the second cash storage cavity 120. The first lifting platform 113 arranged inside the first cash storage cavity 110 has an initial position; when the first lifting platform 113 is located at the initial position, the first switching member 150 is just located at the second position; In the process that the first lifting platform 113 moves from the initial position toward the first inlet 111, the first switching member 150 stays at the second position. A second lifting platform 122 is arranged inside the second cash storage cavity 120. It should be noted that the initial position refers to the position that the first lifting platform 113 can reach when the first cash storage cavity 110 stores the maximum number of cash. In this embodiment, since the preset direction is vertical, the initial position is the lowest position that the first lifting platform 113 can reach, and the first dispensing position is below the initial position.

In some embodiments, the second switching member 140 is arranged adjacent to the first inlet 111 and the first switching member 150 is arranged adjacent to the first outlet 112; the second switching member 140 is in transmission connection with a motor, and the motor drives the second switching member 140 to rotate, thus connecting or disconnecting the first inlet and outlet 101 and the first inlet 111; the first cash storage cavity 110 is used for storing a first type of cash, and the second cash storage cavity 120 is used for storing a second type of cash.

It should be noted that when the first type of cash is deposited in the cash box 010, the second switching member 140 is controlled so that the first inlet and outlet 101 is connected with the first inlet 111, and the first lifting platform 113 is moved to a first cash receiving position close to the first inlet 111; the cash entering the cash box 010 from the first inlet and outlet 101 is conveyed to the first lifting platform 113 via the first inlet 111, so as to store the cash in the first cash storage cavity 110. The first cash receiving position of the first lifting platform 113 is a position at which the upper surface of the first lifting platform 113 (if cash is stacked on the first lifting platform 113, the upper surface of the uppermost cash) is spaced apart from the first inlet 111 by a set distance. When the first type of cash in the cash box 010 is taken out, the second switching member 140 is controlled to disconnect the first inlet and outlet 101 from the first inlet 111, and the first lifting platform 113 moves to the first dispensing position and is engaged with the linkage assembly 200 to rotate the first switching member 150 to the first position, so that the first inlet and outlet 101 is connected with the first outlet 112, and the cash in the first cash storage cavity 110 can be sent out of the cash box 010 through the first outlet 112 and the first inlet and outlet 101. When the second type of cash is deposited in the cash box 010, the second switching member 140 is controlled to disconnect the first inlet and outlet 101 from the first inlet 111 and drive the first lifting platform 113 to move toward the first inlet 111, optionally, moving to the initial position. The first lifting platform 113 is separated from the linkage assembly 200, so that the linkage assembly 200 rotates the first switching member 150 to the second position; the first inlet and outlet 101 and the first outlet 112 are disconnected and the first inlet and outlet 101 and the second inlet and outlet 121 are connected, so that the cash can be input to the second lifting platform 122 located at a second cash receiving position in the second cash storage cavity 120 through the first inlet and outlet 101 and the second inlet and outlet 121, or the cash on the second lifting platform 122 located at a second dispensing position in the second cash storage cavity 120 can be output.

Figure 4:
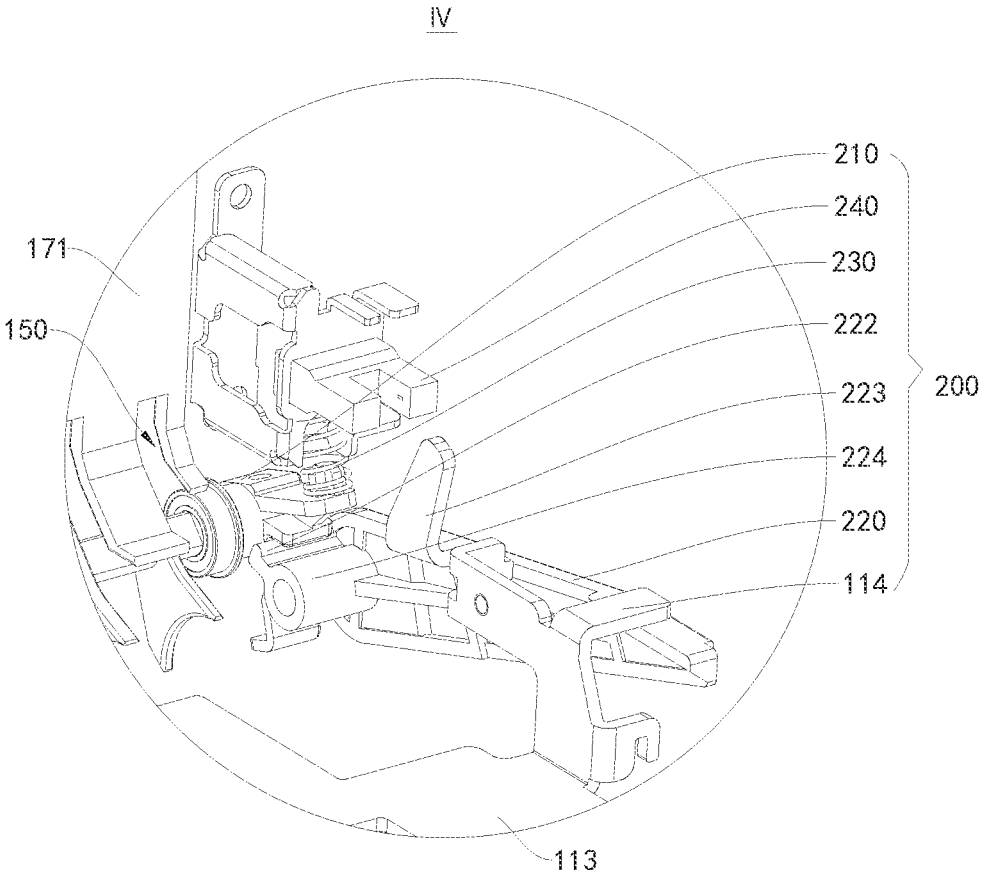
FIG. 4 is an enlarged view of the IV part in FIG. 2.
Figure 5:
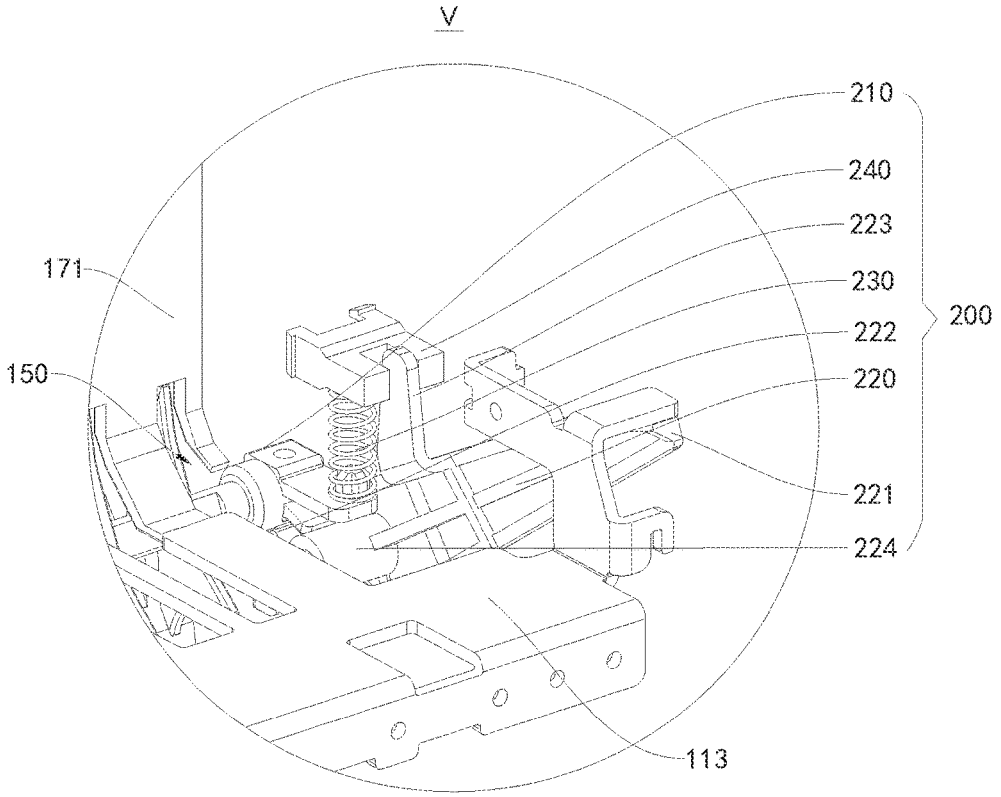
FIG. 5 is an enlarged view of the V part in FIG. 3.
Figure 6:
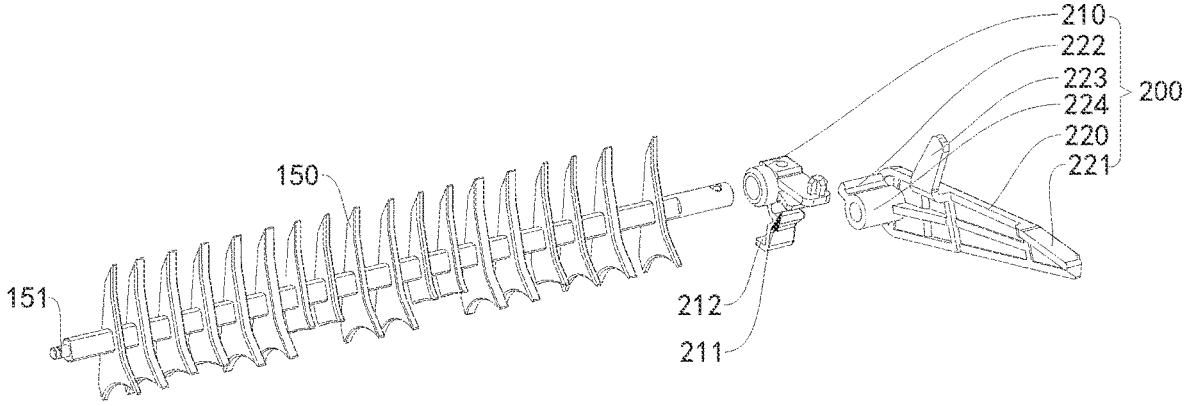
FIG. 6 is an exploded view of a first switching member and part of a linkage assembly according to an embodiment of the present disclosure.

FIG. 6 is an exploded view of a first switching member 150 and part of a linkage assembly 200 according to an embodiment of the present disclosure; referring to FIGS. 4-6, the linkage assembly 200 includes a driving member 210 and a connecting member 220, wherein the driving member 210 is fixed coaxially to the first switching member 150, and the connecting member 220 is pivoted to the box body 100; the connecting member 220 includes a stressed part 221 and a driving part 222, the stressed part 221 is located at the moving path of the first lifting platform 113, and the driving part 222 is connected with the driving member 210. When the first lifting platform 113 is located at the first dispensing position, it presses the stressed part 221 to drive the connecting member 220 to rotate; the driving part 222 of the connecting member 220 drives the driving member 210 to rotate, and the driving member 211 rotates the first switching member 150 to the first position.

In this embodiment, the linkage assembly 200 further includes an elastic element 230, and a first end of the elastic element 230 is connected with the driving member 210, and a second end of the elastic element 230 is connected with the box body 100. The elastic element 230 is configured to enable the driving member 210 have a movement tendency to drive the first switching member 150 to rotate to the second position. It should be noted when the first lifting platform 113 is located at the first dispensing position, the first lifting platform 113 presses the stressed part 221 to drive the connecting member 220 to rotate, and the connecting member 220 drives the driving member 210 to rotate against the elastic force of the elastic element 230, so that the driving member 210 drives the first switching member 150 to rotate to the first position. When the first lifting platform 113 moves toward the first inlet 111, the pressure of the first lifting platform 113 on the stressed part 221 disappears, and the elastic element 230 drives the driving member 210 to rotate, and the driving member 210 drives the first switching member 150 to rotate to the second position. When the first lifting platform 113 moves to the initial position, the elastic element 230 drives the driving member 210 which accordingly drives the first switching member 150 to rotate to the second position. It should be noted that when the first lifting platform 113 is located at the initial position or any first cash receiving position above the initial position, the first lifting platform 113 does not press the stressed part 221 of the connecting member 220, so that the connecting member 220 drives the driving member 210 to rotate under the elastic action of the elastic element 230, and the driving member 210 rotates the first switching member 150 to the second position, thus disconnecting the first inlet and outlet 101 from the first outlet 112 and connecting the first inlet and outlet 101 with the second inlet and outlet 121.

It should be noted in the embodiment that the elastic element 230 is a tension spring; optionally, in other embodiments, the elastic element 230 may also be a torsion spring, an elastic rubber strip, or the like.

Figure 7:
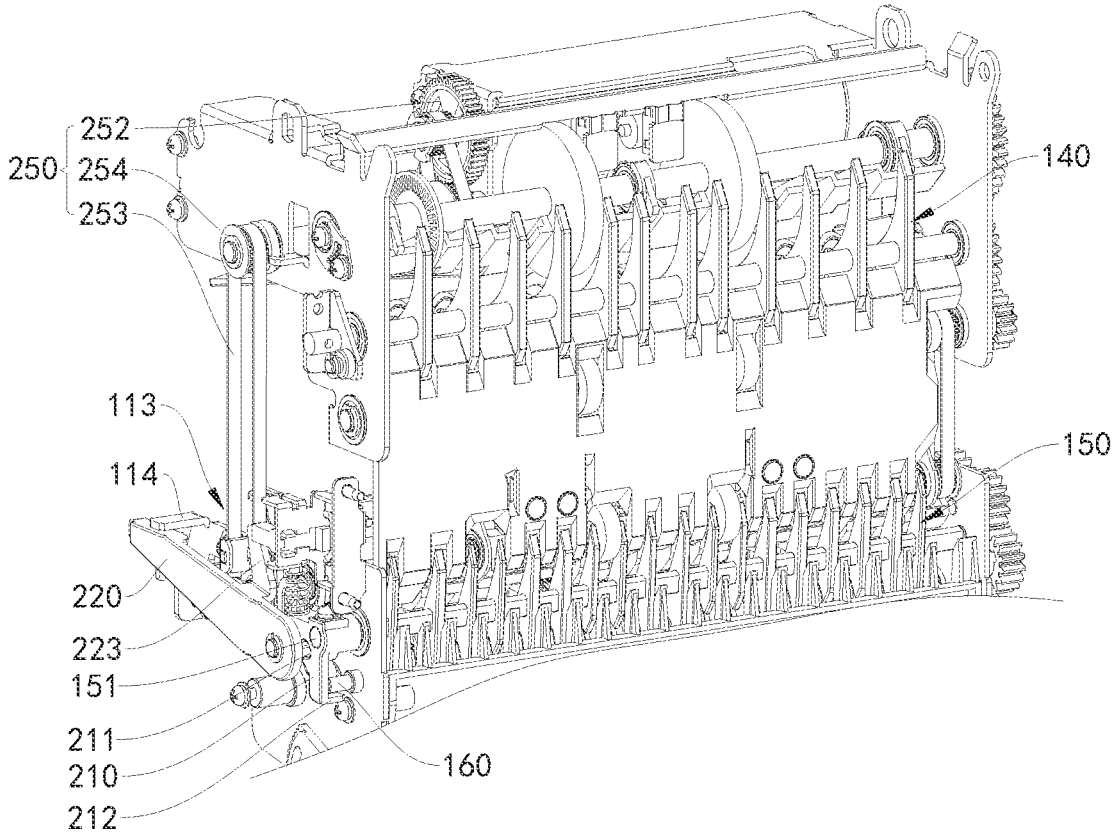
FIG. 7 is a structural schematic view of a linkage assembly, a first switching member and a driving assembly according to an embodiment of the present disclosure.

FIG. 7 is a structural schematic view of a linkage assembly 200, a first switching member 150 and a driving assembly 250 according to an embodiment of the present disclosure; referring to FIGS. 4 and 7, the first lifting platform 113 in this embodiment further includes a pressing part 114. The pressing part 114 is configured to engage with the stressed part 221 of the connecting member 220. It should be noted that when the first lifting platform 113 moves from the initial position to the first dispensing position, the pressing part 114 presses the stressed part 221, that is, the first lifting platform 113 presses the stressed part 221, so that the connecting member 220 rotates in the first direction against the elastic action of the elastic element 230, and the driving member 210 is driven to rotate the first switching member 150 to the first position.

Referring to FIG. 6, the first switching member 150 in the embodiment is rotatably arranged in the transfer passage 130 through the switching shaft 151, and the driving member 210 is fixedly sleeved on the switching shaft 151, so that when the connecting member 220 drives the driving member 210 to rotate, the first switching member 150 is also driven to rotate. In some embodiments, the first switching member 150 is fixedly connected to the switching shaft 151, and the switching shaft 151 is rotatably arranged in the box body 100.

Referring to FIGS. 4-6, the connecting member 220 in the embodiment is pivoted to the box body 100 through a connecting shaft 224, and the driving part 222 is provided on the connecting shaft 224.

In some embodiments, referring to FIG. 6, the driving member 210 is provided with a driving slot 211, and the driving part 222 of the connecting member 220 is in plug connection with the driving slot 211, so that when the connecting member 220 rotates in the first direction, the driving member 210 is stably driven to rotate and rotates the first switching member 150 to the first position.

In some embodiments, referring to FIG. 7, the driving member 210 further includes a limiting part 212, and the box body 100 further includes a resisting part 160. When the first switching member 150 is located at the first position, the limiting part 212 is engaged with the resisting part 160. In some embodiments, the resisting part 160 is provided below the switching shaft 151; when the first lifting platform 113 moves downward to the first dispensing position, it presses the connecting member 220, so that the connecting member 220 rotates against the action of the elastic element 230 and rotates the first switching member 150 to the first position; the resisting part 160 is engaged with the limiting part 212 to prevent the first switching member 150 from continuing to rotate after rotating to the first position, that is, the maximum rotation angle of the first switching member 150 is limited by the engagement between the limiting part 212 and the resisting part 160, so as to improve the accuracy of the first switching member 150 when rotating to the first position, ensure the smoothness of the transfer passage 130, and prevent problems such as jamming cash.

Figure 8:
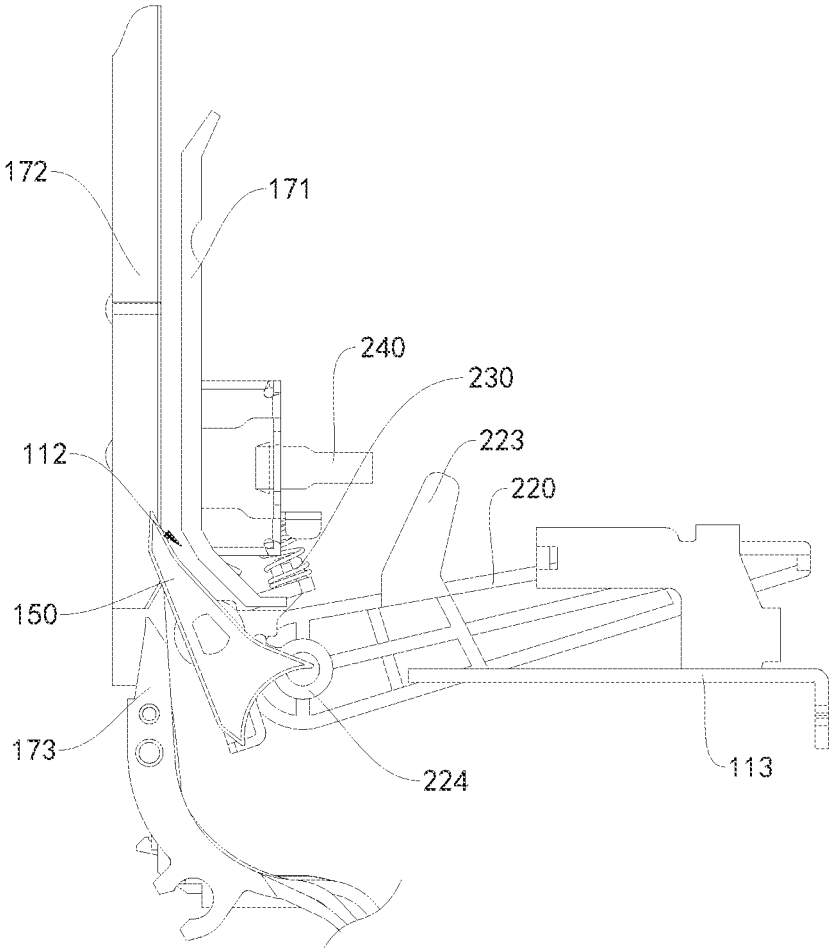
FIG. 8 is a structural schematic view of a second view of a linkage assembly and a first switching member when a first lifting platform is in the first dispensing position according to an embodiment of the present disclosure.
Figure 9:
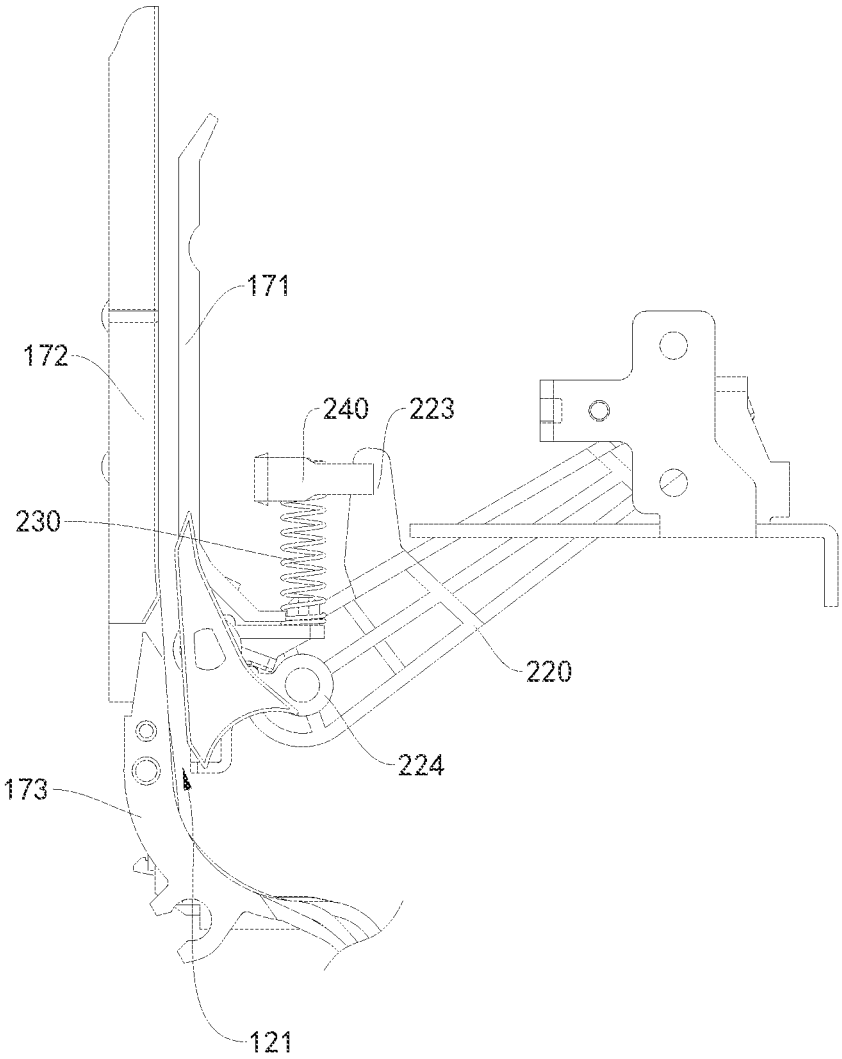
FIG. 9 is a structural schematic view of the second view of a linkage assembly and a first switching member when a first lifting platform is in the initial position according to an embodiment of the present disclosure.

Referring to FIGS. 2 and 3, the linkage assembly 200 in the embodiment further includes a sensor 240, and the connecting member 220 further includes a detection part 223. Referring to FIGS. 4 and 8, when the first switching member 150 is located at the first position, the detection part 223 is separated from the sensor 240, and the sensor 240 outputs a first detection signal. Referring to FIGS. 5 and 9, when the first switching member 150 is located at the second position, the detection part 223 is engaged with the sensor 240, and the sensor 240 outputs a second detection signal; The cooperation of the detection part 223 and the sensor 240 can detect the position state of the first lifting platform 113 and the first switching member 150. It should be noted that when the sensor 240 outputs the first detection signal, the transfer passage 130 is connected with the first outlet 112, that is, the first switching member 150 is located at the first position, so the first inlet and outlet 101 is connected with the first outlet 112, and the first lifting platform 113 is located at the first dispensing position (as shown in FIGS. 2 and 8). When the sensor 240 outputs the second detection signal, the transfer passage 130 is connected with the second inlet and outlet 121, that is, the first switching member 150 is located at the second position, so the first inlet and outlet 101 is disconnected from the first outlet 112 and the first inlet and outlet 101 is connected with the second inlet and outlet 121, and the first lifting platform 113 is located at the initial position (as shown in FIGS. 3 and 9).

Optionally, in other embodiments, the detection part 223 is engaged with the sensor 240 when the first switching member 150 is located at the first position, and separated from the sensor 240 when the first switching member 150 is located at the second position.

It should be noted that the sensor 240 is a photoelectric sensor, an electromagnetic sensor, a mechanical sensor, or the like.

Figure 10:
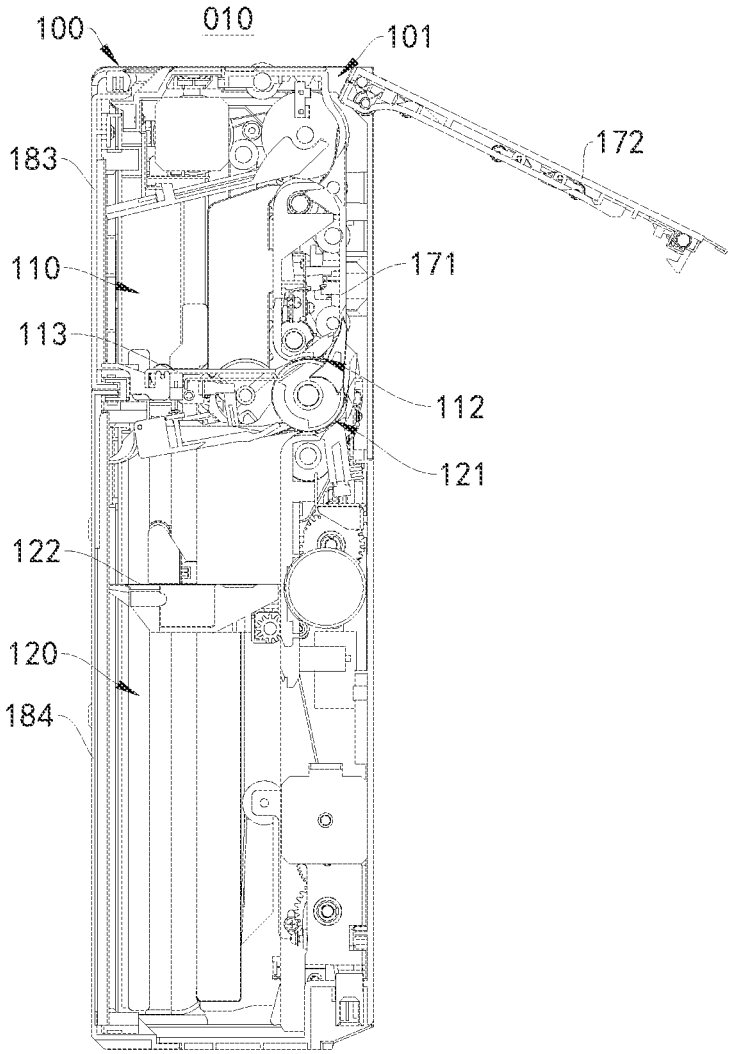
FIG. 10 is a section view of a cash box in a second state according to an embodiment of the present disclosure.

FIG. 10 is a section view of a cash box 010 in a second state according to an embodiment of the present disclosure. Referring to FIGS. 1 and 10, the cash box 010 in the embodiment further includes a first passage plate 171 and a second passage plate 172, wherein the first passage plate 171 is fixedly arranged on the box body 100, and the second passage plate 172 is pivoted to the box body 100. The first passage plate 171 is located between the first inlet 111 and the first outlet 112, and the second passage plate 172 is configured to have an open position and a closed position. When the second passage plate 172 is located at the closed position, at least a port of the second passage plate 172 is opposite to and spaced apart from the first passage plate 171 and forms a first portion of the transfer passage 130, and cash is input or output of the first cash storage cavity 110 through the space formed by the second passage plate 172 in the closed position and the first passage plate 171. A part of the transfer passage 130 is open when the second passage plate 172 is in the open position. It should be noted that the upper portion of the second passage plate 172 is pivoted to the box body 100 via a pivot shaft.

It should be noted that when the first switching member 150 is located at the first position, the first switching member 150 is in plug connection with the second passage plate 172, so that the first inlet and outlet 101 is connected with the first outlet 112 and the first inlet and outlet 101 is disconnected from the second inlet and outlet 121. When the first switching member 150 is located at the second position, the first switching member 150 and the second passage plate 172 are relatively parallel and spaced apart, so that the first inlet and outlet 101 is disconnected from the first outlet 112 and the first inlet and outlet 101 is connected with the second inlet and outlet 121.

Referring to FIGS. 8 and 9, the cash box 010 in the embodiment further includes a third passage plate 173, and the third passage plate 173 is arranged between the second inlet and outlet 121 and the second passage plate 172 in the closed position; when the first switching member 150 is located at the second position, the first switching member 150 and the third passage plate 173 are relatively parallel and spaced apart to form the second portion of the transfer passage 130 and connect the first inlet and outlet 101 with the second inlet and outlet 121.

Figure 11:
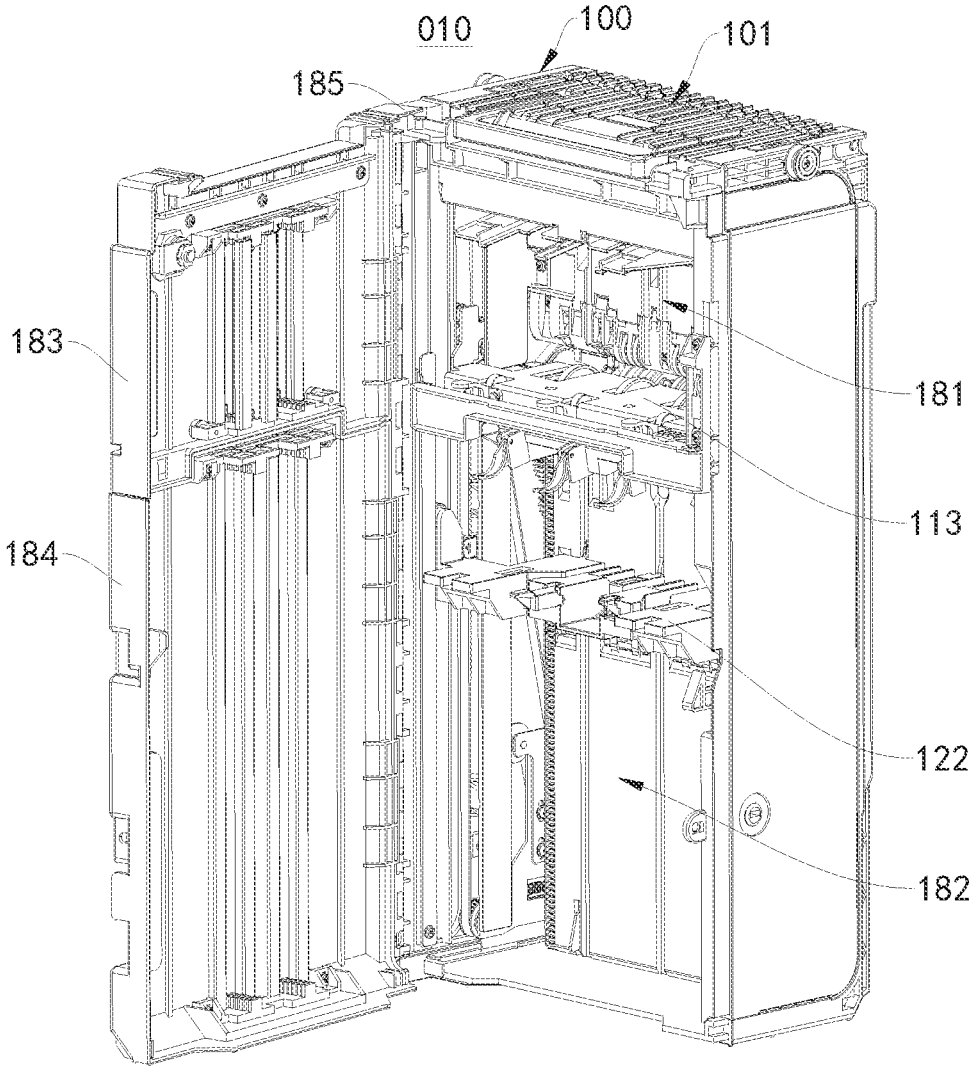
FIG. 11 is a structural schematic view of when a first box door and a second box door of a cash box in an open state according to an embodiment of the present disclosure.
Figure 12:
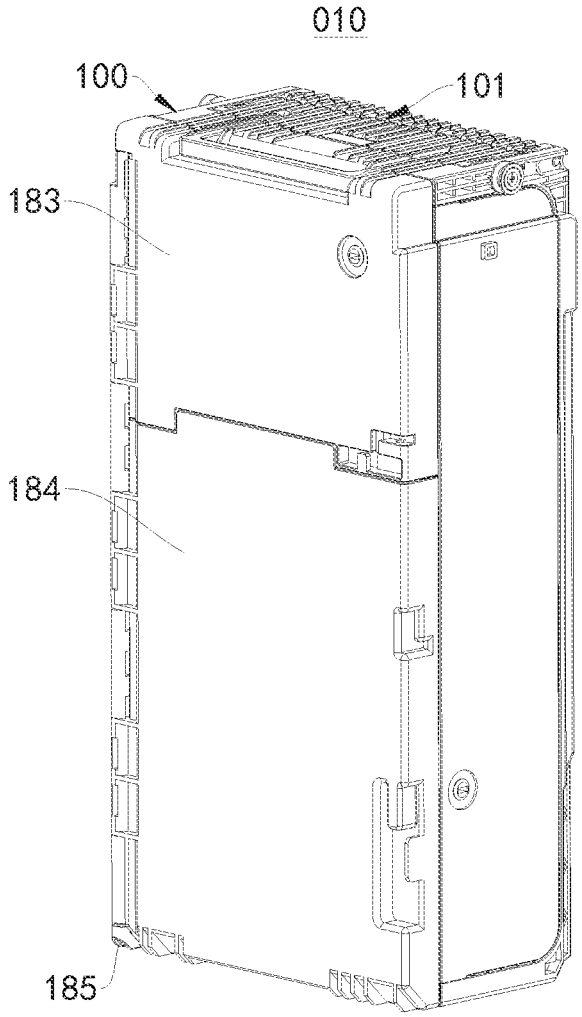
FIG. 12 is a structural schematic view of a first box door and a second box door of a cash box in close state according to an embodiment of the present disclosure.

FIG. 11 is a structural schematic view of when a first box door 183 and a second box door 184 of a cash box 010 in an open state according to an embodiment of the present disclosure, FIG. 12 is a structural schematic view of a first box door 183 and a second box door 184 of a cash box 010 in close state according to an embodiment of the present disclosure. The box body 100 in the embodiment is provided with a first opening 181 and a second opening 182, wherein the first opening 181 is connected with the first cash storage cavity 110, and the second opening 182 is connected with the second cash storage cavity 120. The cash box 010 further includes a first box door 183 and a second box door 184, both of which are pivoted with the box body 100, and the first box door 183 is configured to open or close the first opening 181, and the second box door 184 is configured to open or close the second opening 182. The first box door 183 and the second box door 184 in the embodiment are pivoted with the box body 100 via one pivot shaft 185, and the pivot shaft 185 extends in the vertical direction. Optionally, in other embodiments, the first box door 183 and the second box door 184 are pivoted to the box body 100 via a pivot shafts respectively.

Referring to FIGS. 1 and 7, the cash box 010 in the embodiment further includes a driving assembly 250 for moving the first lifting platform 113 up and down, and the driving assembly 250 includes a first motor 251, a driving wheel 252, a driving belt 253 and two belt pulleys 254, two belt pulleys 254 are spaced apart in the vertical direction; the driving belt 253 is sleeved on two belt pulleys 254; the driving wheel 252 is in transmission connection with the output shaft of the first motor 251 and with one of the two belt pulleys 254; the driving belt 253 is fixedly connected to the first lifting platform 113. When the output shaft of the first motor 251 rotates, the driving wheel 252 and belt pulleys 254 are driven to rotate, so that the rotating belt pulleys 254 drives the driving belt 253 to move, and drives the first lifting platform 113 up or down. It should be noted that the cash box 010 in the embodiment further includes the driving assembly for moving the second lifting platform 122 up and down, and its structure and operating principles are similar to those of the driving assembly 250 for moving the first lifting platform 113 up and down, and will not be described here.

Referring to FIG. 1, the cash box 010 in the embodiment further includes a cash collecting and separating mechanism 260; the cash collecting and separating mechanism 260 is arranged between the first cash storage cavity 110 and the second cash storage cavity 120 for outputting cash from any one of the first cash storage cavity 110 and the second cash storage cavity 120 to the transfer passage 130; the cash collecting and separating mechanism 260 includes a separation roller 261, a pickup roller 262, a first gate roller 263 and a second gate roller 264; the pickup roller 262 is located upstream of the separation roller 261 in the cash output direction; the first gate roller 263 and the second gate roller 264 are located on the upper and lower sides of the pickup roller 262 and are respectively arranged relative to the separation roller 261; the first outlet 112 of the first cash storage cavity 110 is formed between the separation roller 261 and the first gate roller 263, and the second inlet and outlet 121 of the second cash storage cavity 120 is formed between the separation roller 261 and the second gate roller 264. In some embodiments, the cash collecting and separating mechanism 260 further includes a second motor 265. The second motor 265 is in transmission connection with the separation roller 261, the pickup roller 262, the first gate roller 263 and the second gate roller 264. When the output shaft of the second motor 265 rotates in the forward direction, the cash can be output from the first cash storage cavity 110, and the cash can also be input to the second cash storage cavity 120. When the output shaft of the second motor 265 rotates in the reverse direction, the cash can be output from the second cash storage cavity 120.

Referring to FIG. 1, the cash box 010 in the embodiment further includes a first guiding plate 271. The first guiding plate 271 is provided inside the box body 100 and located at the upper part of the first cash storage cavity 110. The first end of the first guiding plate 271 is adjacent to the first inlet 111, and the second end of the first guiding plate 271 extends downward with a dip angle for guiding the movement direction of the cash entering the first cash storage cavity 110 through the first inlet 111, that is, the cash entering the first cash storage cavity 110 through the first inlet 111 can be moved to the first lifting platform 113 located at the first cash receiving position under the guidance of the first guiding plate 271.

Referring to FIG. 1, the cash box 010 in the embodiment further includes a feeding roller 266. The feeding roller 266 is rotatably arranged inside the box body 100 and is adjacent to the first inlet 111. When the cash enters the cash box 010 through the first inlet and outlet 101, the feeding roller 266 moves the cash toward the first inlet 111 and the first guiding plate 271.

Referring to FIG. 1, the cash box 010 in the embodiment further includes a second guiding plate 272. The second guiding plate 272 is arranged inside the box body 100 and located at the upper part of the second cash storage cavity 120. The first end of the second guiding plate 272 is adjacent to the second inlet and outlet 121 and pivoted with the box body 100. The second guiding plate 272 is capable of rotating around an axis of the pivot shaft and has two positions: a cash entering position and a lifting position deviating from the cash entering position. When the second guiding plate 272 is located at the cash entering position, its second end is inclined downward and shields the pickup roller 262. The cash entering the second cash storage cavity 120 through the second inlet and outlet 121 does not contact the pickup roller 262 and moves along the second guiding plate 272 in the cash entering position. When the second guiding plate 272 is located at the lifting position, the second guiding plate 272 exposes the pickup roller 262, and the cash in the second cash storage cavity 120 can contact the pickup roller 262.

Figure 13:
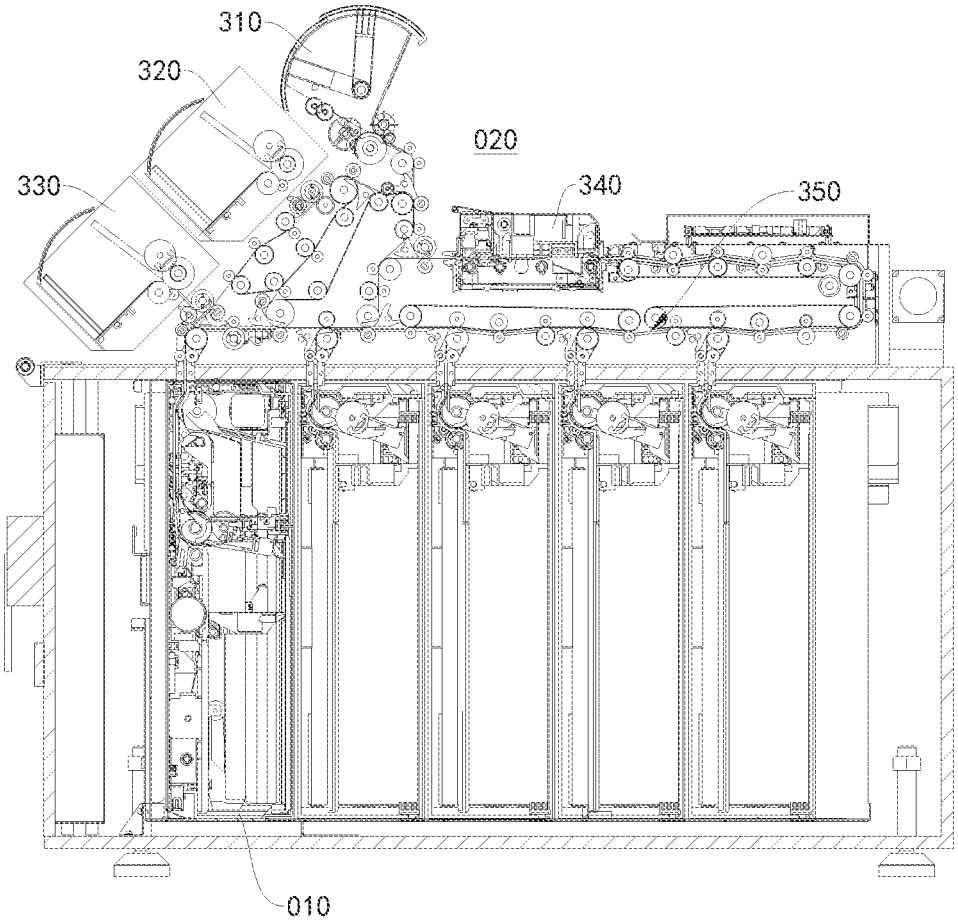
FIG. 13 is a section view of a cash recycling and handling device according to an embodiment of the present disclosure.

FIG. 13 is a section view of a cash recycling and handling device 020 according to an embodiment of the present disclosure. Referring to FIG. 13, the cash recycling and handling device 020 is provided in the embodiment. The cash recycling and handling device 020 includes the above-mentioned cash box 010, and it further includes a feeding mechanism 310, a dispensing mechanism 320, a temporary storage mechanism 330, a cash identifying mechanism 340 and a common passage 350, the common passage 350 is configured to convey cash among the feeding mechanism 310, the dispensing mechanism 320, the temporary storage mechanism 330, the cash identifying mechanism 340 and the cash box 010. The feeding mechanism 310 is used for receiving cash and conveying it to the cash identifying mechanism 340, and the dispensing mechanism 320 is used for outputting cash, and the temporary storage mechanism 330 is used for temporarily holding cash before the transaction is actually completed.

The cash box 010 used in the cash recycling and handling device 020 in the embodiment of the present disclosure is capable of storing two types of cash separately. The first switching member 150 can be rotated between the second position and the first position by driving the first lifting platform 113 to switch between the initial position and the first dispensing position. In this way, the first switching member 150 does not need an additional driving device, thus reducing the overall cost of the device and simplifying the control.

In conclusion, when the cash box in the embodiment of the present disclosure is used, the connection or disconnection between the first inlet and outlet and the first outlet can be realized by using the first switching member. When the first lifting platform arranged in the first cash storage cavity moves to the first dispensing position, the linkage assembly is driven to rotate the first switching member to the first position, so as to connect the first inlet and outlet with the first outlet. When the first lifting platform moves toward the first inlet, the linkage assembly is driven to rotate the first switching member to the second position, so as to disconnect the first inlet and outlet from the first outlet and connect the first inlet and outlet with the second inlet and outlet. In this way, the linkage assembly, driven by the movement of the first lifting platform, drives the first switching member to switch between the first position and the second position, and the first switching member does not need an additional driving mechanism, thus reducing the cost and simplifying the control of the cash box.

The cash box provided in the cash recycling and handling device in the embodiment of the present disclosure controls the rotation of the first switching member by the movement of the first lifting platform, so as to realize the connection or disconnection between the first inlet and outlet and the first outlet. In this way, the first switching member does not need an additional driving mechanism, thus reducing the cost and simplifying the control of the cash recycling and handling device.

What is claimed is:

1. A cash box, comprising:

a box body which has a first inlet and outlet;

a first cash storage cavity and a second cash storage cavity provided in the box body in sequence in a preset direction, wherein a first inlet and a first outlet are respectively arranged at the two ends of the first cash storage cavity in the preset direction, and a first lifting platform is provided inside the first cash storage cavity, and the first lifting platform is capable of moving back and forth in the preset direction and is capable of being located at a first dispensing position adjacent to the first outlet, and one end of the second cash storage cavity adjacent to the first outlet is provided with a second inlet and outlet;

a transfer passage connecting the first inlet and outlet and the second inlet and outlet;

a first switching member rotatably provided in the transfer passage, wherein the first switching member is capable of being located at a first position and a second position, and when the first switching member is located at the first position, the first inlet and outlet is connected with the first outlet and is disconnected from the second inlet and outlet, and when the first switching member is located at the second position, the first inlet and outlet is disconnected from the first outlet and is connected with the second inlet and outlet;

a linkage assembly in transmission connection with the first switching member, wherein the linkage assembly is capable of engaging with or separated from the first lifting platform, and when the first lifting platform moves to the first dispensing position, the first lifting platform is engaged with the linkage assembly to rotate the first switching member to the first position, and when the first lifting platform moves to the first inlet, the linkage assembly rotates the first switching member to the second position.

2. The cash box of claim 1, wherein the linkage assembly comprises a driving member and a connecting member; the driving member is fixed to the first switching member, and the connecting member is pivoted to the box body; the connecting member comprises a stressed part and a driving part, wherein the stressed part is located at the moving path of the first lifting platform, and the driving part is configured to be connected to the driving member;

when the first lifting platform is located at the first dispensing position, the first lifting platform presses the stressed part to drive the connecting member to rotate, so that the connecting member drives the driving member which accordingly drives the first switching member to the first position.

3. The cash box of claim 2, wherein the linkage assembly further comprises an elastic element; the first end of the elastic element is connected with the driving member, and the second end of the elastic element is connected with the box body; the elastic element is configured to enable the driving member have a movement tendency to drive the first switching member to rotate to the second position.

4. The cash box of claim 2, wherein the driving member is provided with a driving slot, and the driving part is in plug connection with the driving slot.

5. The cash box of claim 2, wherein the driving member further comprises a limiting part, and the box body further comprises a resisting part; when the first switching member is located at the first position, the limiting part is engaged with the resisting part.

6. The cash box of claim 2, wherein the linkage assembly further comprises a sensor, and the connecting member further comprises a detection part; when the first switching member is located at the first position, the detection part is separated from the sensor; when the first switching member is located at the second position, the detection part is engaged with the sensor.

7. The cash box of claim 2, wherein the linkage assembly further comprises a sensor, and the connecting member further comprises a detection part; when the first switching member is located at the first position, the detection part is engaged with the sensor; when the first switching member is located at the second position, the detection part is separated from the sensor.

8. The cash box of claim 1, further comprising a first passage plate and a second passage plate, wherein the first passage plate is fixed to the box body, and the second passage plate is pivoted to the box body; the first passage plate is located between the first inlet and the first outlet, and the second passage plate is capable of being at an open position and a closed position;

when the second passage plate is located at the closed position, at least a part of the second passage plate is oppositely arranged to the first passage plate at intervals and forms a first portion of the transfer passage; when the second passage plate is located at the open position, part of the transfer passage is open.

9. The cash box of claim 8, wherein when the first switching member is located at the first position, it is in plug connection with the second passage plate; when the first switching member is located at the second position, the first switching member and the second passage plate are relatively parallel and spaced apart.

10. The cash box of claim 8, further comprising a third passage plate, wherein the third passage plate is arranged between the second inlet and outlet and the second passage plate in the closed position; when the first switching member is located at the second position, the first switching member and the third passage plate are relatively parallel and spaced apart to form a second portion of the transfer passage and connect the first inlet and outlet with the second inlet and outlet.

11. A cash recycling and handling device, comprising a common passage configured to convey cash, and a cash box, wherein the cash box comprises:

a box body which has a first inlet and outlet;

a first cash storage cavity and a second cash storage cavity provided in the box body in sequence in a preset direction, wherein a first inlet and a first outlet are respectively arranged at the two ends of the first cash storage cavity in the preset direction, and a first lifting platform is provided inside the first cash storage cavity, and the first lifting platform is capable of moving back and forth in the preset direction and is capable of being located at a first dispensing position adjacent to the first outlet, and one end of the second cash storage cavity adjacent to the first outlet is provided with a second inlet and outlet;

a transfer passage connecting the first inlet and outlet and the second inlet and outlet;

a first switching member rotatably provided in the transfer passage, wherein the first switching member is capable of being located at a first position and a second position, and when the first switching member is located at the first position, the first inlet and outlet is connected with the first outlet and is disconnected from the second inlet and outlet, and when the first switching member is located at the second position, the first inlet and outlet is disconnected from the first outlet and is connected with the second inlet and outlet;

a linkage assembly in transmission connection with the first switching member, wherein the linkage assembly is capable of engaging with or separated from the first lifting platform, and when the first lifting platform moves to the first dispensing position, the first lifting platform is engaged with the linkage assembly to rotate the first switching member to the first position, and when the first lifting platform moves to the first inlet the linkage assembly rotates the first switching member to the second position.

12. The cash recycling and handling device of claim 11, wherein the linkage assembly comprises a driving member and a connecting member; the driving member is fixed to the first switching member, and the connecting member is pivoted to the box body;

the connecting member comprises a stressed part and a driving part, wherein the stressed part is located at the moving path of the first lifting platform, and the driving part is configured to be connected to the driving member;

when the first lifting platform is located at the first dispensing position, the first lifting platform presses the stressed part to drive the connecting member to rotate, so that the connecting member drives the driving member which accordingly drives the first switching member to the first position.

13. The cash recycling and handling device of claim 12, wherein the linkage assembly further comprises an elastic element; the first end of the elastic element is connected with the driving member, and the second end of the elastic element is connected with the box body; the elastic element is configured to enable the driving member have a movement tendency to drive the first switching member to rotate to the second position.

14. The cash recycling and handling device of claim 12, wherein the driving member is provided with a driving slot, and the driving part is in plug connection with the driving slot.

15. The cash recycling and handling device of claim 12, wherein the driving member further comprises a limiting part, and the box body further comprises a resisting part;

when the first switching member is located at the first position, the limiting part is engaged with the resisting part.

16. The cash recycling and handling device of claim 12, wherein the linkage assembly further comprises a sensor, and the connecting member further comprises a detection part;

when the first switching member is located at the first position, the detection part is separated from the sensor; when the first switching member is located at the second position, the detection part is engaged with the sensor.

17. The cash recycling and handling device of claim 12, wherein the linkage assembly further comprises a sensor, and the connecting member further comprises a detection part;

when the first switching member is located at the first position, the detection part is engaged with the sensor; when the first switching member is located at the second position, the detection part is separated from the sensor.

18. The cash recycling and handling device of claim 11, wherein the cash box further comprises a first passage plate and a second passage plate, wherein the first passage plate is fixed to the box body, and the second passage plate is pivoted to the box body;

the first passage plate is located between the first inlet and the first outlet, and the second passage plate is capable of being at an open position and a closed position;

when the second passage plate is located at the closed position, at least a part of the second passage plate is oppositely arranged to the first passage plate at intervals and forms a first portion of the transfer passage; when the second passage plate is located at the open position, part of the transfer passage is open.

19. The cash recycling and handling device of claim 18, wherein when the first switching member is located at the first position, it is in plug connection with the second passage plate;

when the first switching member is located at the second position, the first switching member and the second passage plate are relatively parallel and spaced apart.

20. The cash recycling and handling device of claim 18, wherein the cash box further comprises a third passage plate, and the third passage plate is arranged between the second inlet and outlet and the second passage plate in the closed position;

when the first switching member is located at the second position, the first switching member and the third passage plate are relatively parallel and spaced apart to form a second portion of the transfer passage and connect the first inlet and outlet with the second inlet and outlet.

* * * * *